US009032567B1

(12) United States Patent
Galgano

(10) Patent No.: US 9,032,567 B1
(45) Date of Patent: May 19, 2015

(54) SINK COVERING ASSEMBLY

(76) Inventor: Ann Marie Galgano, Staten Island, NY (US)

( * ) Notice: Subject to any disclaimer, the term of this patent is extended or adjusted under 35 U.S.C. 154(b) by 293 days.

(21) Appl. No.: 13/546,785

(22) Filed: Jul. 11, 2012

(51) Int. Cl.
*E03C 1/186* (2006.01)
*A47J 47/20* (2006.01)

(52) U.S. Cl.
CPC . *E03C 1/186* (2013.01); *A47J 47/20* (2013.01)

(58) Field of Classification Search
USPC ..... 4/654, 657, 661; 160/370.21; D23/308
See application file for complete search history.

(56) References Cited

U.S. PATENT DOCUMENTS 914,120 A * 3/1909 Demarest ..... 4/638
2,319,726 A * 5/1943 Duggan ..... 248/362
4,305,166 A * 12/1981 Rose ..... 4/631
4,351,073 A * 9/1982 Elsas ..... 4/654
4,893,668 A * 1/1990 Nomura ..... 160/327
5,406,656 A 4/1995 Somerton
5,815,855 A 10/1998 McKeehan et al.
6,925,964 B2 * 8/2005 Jeffery ..... 119/673
6,959,461 B1 11/2005 Sanchez
D517,670 S 3/2006 Rocci
7,086,099 B2 8/2006 Rocci
D548,657 S * 8/2007 Eskandry ..... D12/183
7,685,654 B1 * 3/2010 Jones ..... 4/655

* cited by examiner

*Primary Examiner* — Huyen Le
*Assistant Examiner* — Nicholas Ros

(57) ABSTRACT

A sink covering assembly for selectively concealing the contents of a sink includes a screen with a peripheral edge. A plurality of suction cups is coupled to the screen adjacent to the peripheral edge of the screen. Each of the suction cups is configured for engaging a surface adjacent to a sink whereby the screen extends over and covers the sink.

7 Claims, 3 Drawing Sheets

SINK COVERING ASSEMBLY

BACKGROUND OF THE DISCLOSURE

Field of the Disclosure

The disclosure relates to sink coverings and more particularly pertains to a new sink covering for selectively concealing the contents of a sink.

SUMMARY OF THE DISCLOSURE

An embodiment of the disclosure meets the needs presented above by generally comprising sink covering assembly having a screen including a peripheral edge. A plurality of suction cups is coupled to the screen adjacent to the peripheral edge of the screen. Each of the suction cups is configured for engaging a surface adjacent to a sink whereby the screen extends over and covers the sink.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
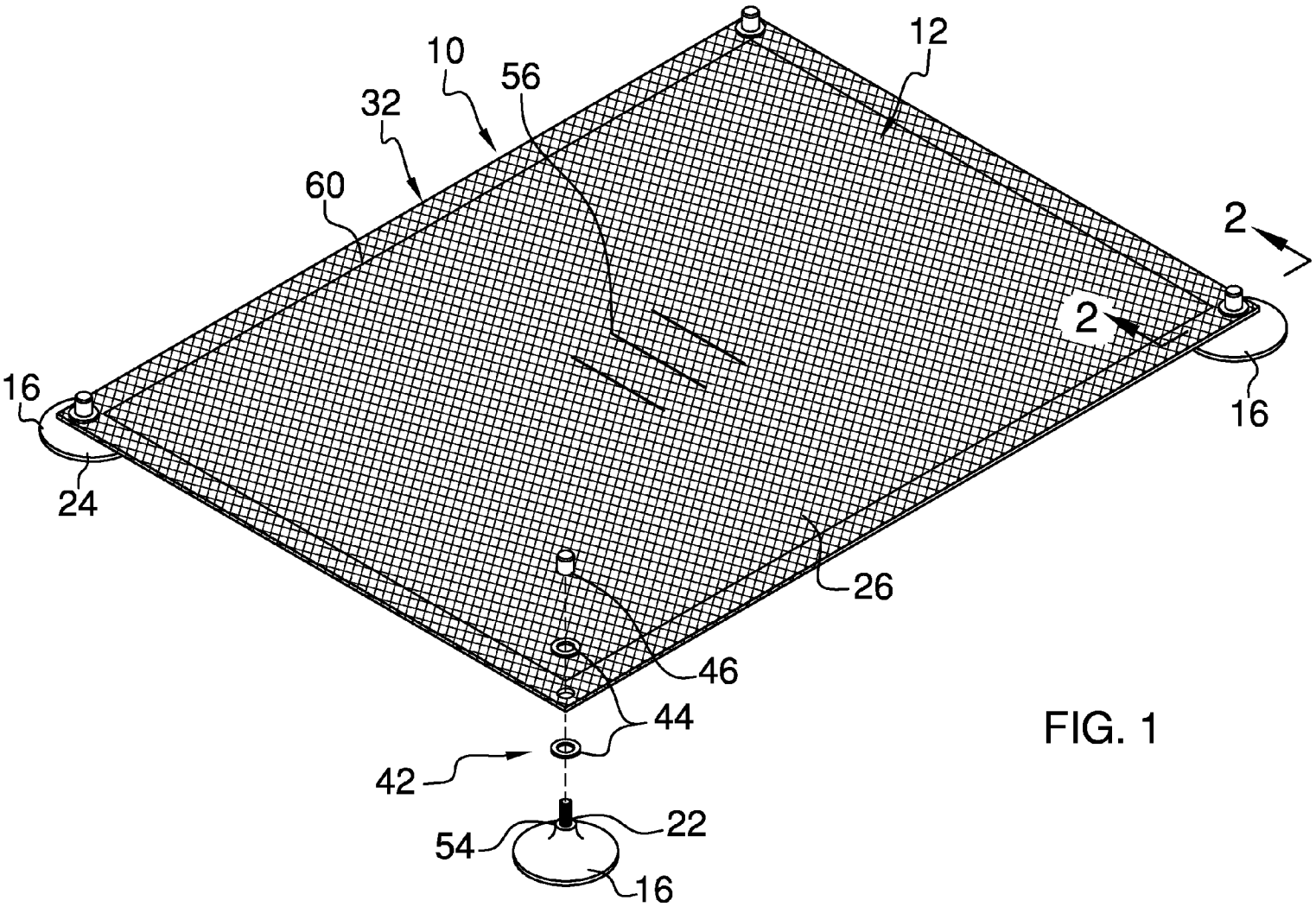
FIG. 1 is a top front side perspective view of a sink covering assembly according to an embodiment of the disclosure.
Figure 2:
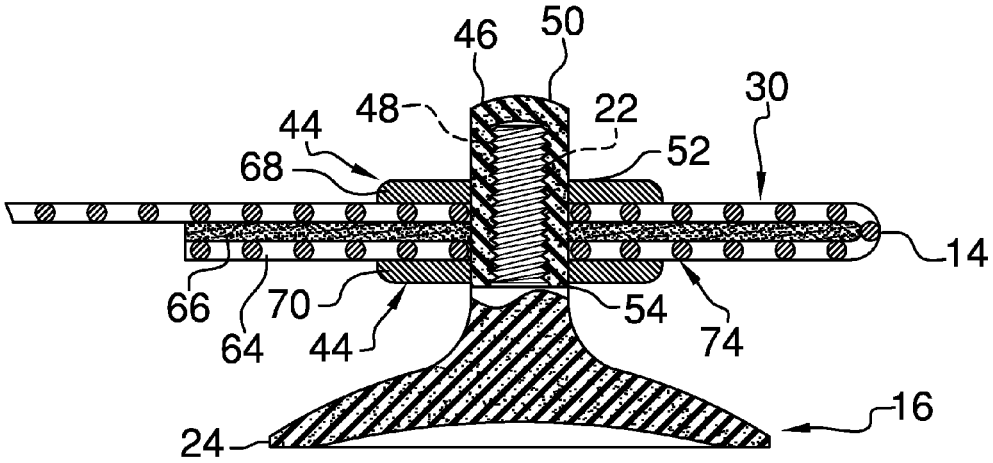
FIG. 2 is a cross-sectional view of an embodiment of the disclosure taken along line 2-2 of FIG. 1.
Figure 3:
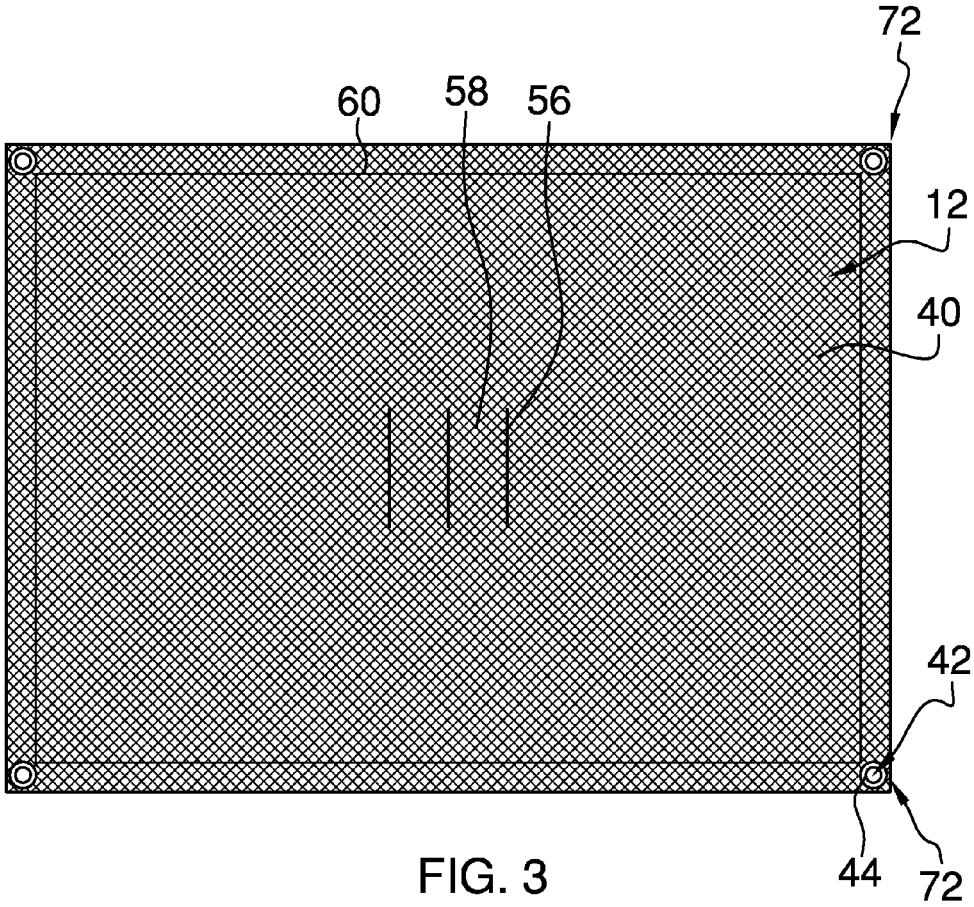
FIG. 3 is a bottom view of an embodiment of the disclosure.
Figure 4:
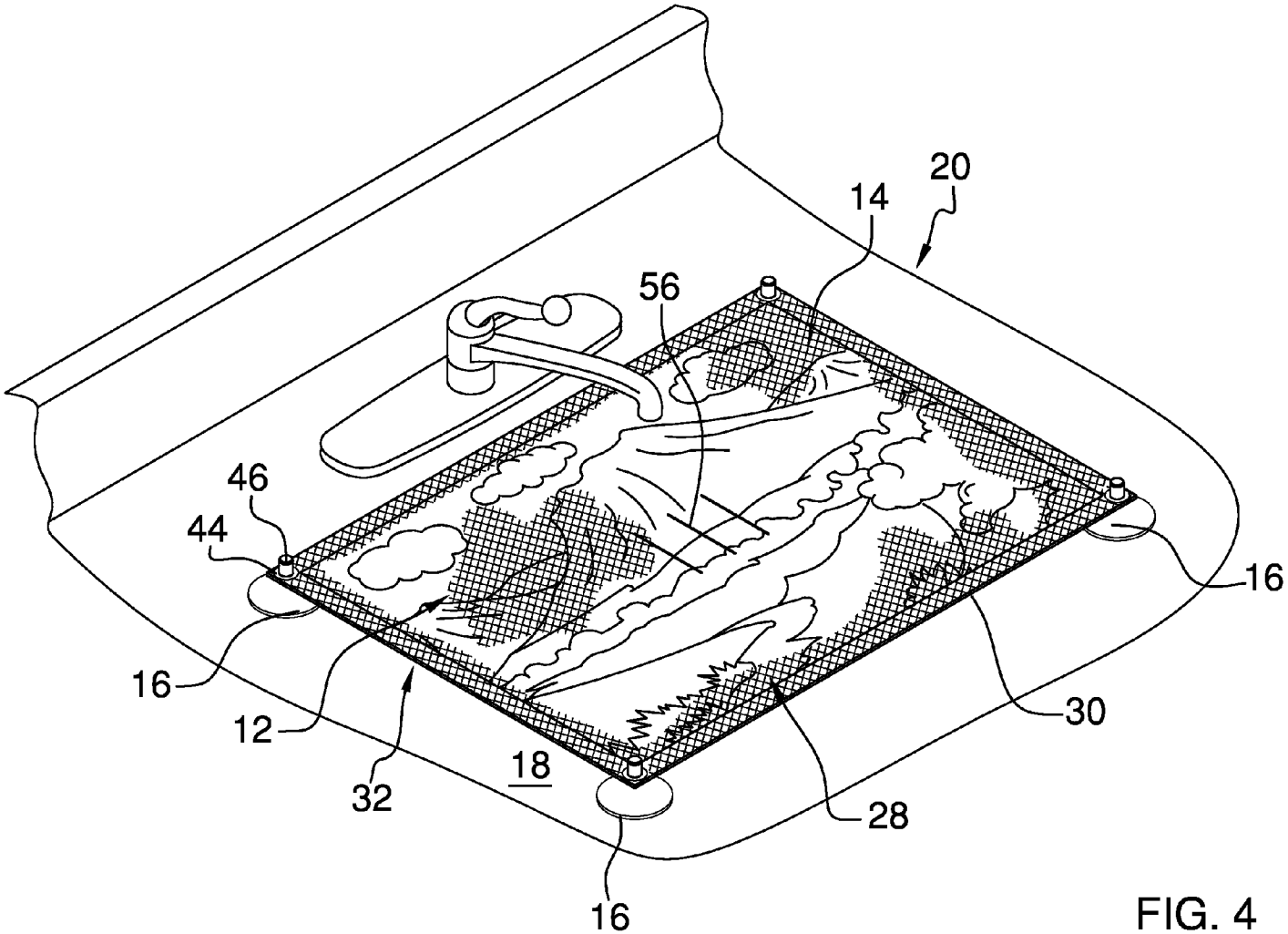
FIG. 4 is a top side perspective view of an embodiment of the disclosure in use.

With reference now to the drawings, and in particular to FIGS. 1 through 4 thereof, a new sink covering embodying the principles and concepts of an embodiment of the disclosure and generally designated by the reference numeral 10 will be described.

As best illustrated in FIGS. 1 through 4, a sink covering assembly 10 has a rectangular screen 12 with a peripheral edge 14. A plurality of suction cups 16 is coupled to the screen 12 adjacent to the peripheral edge 14 of the screen 12. Each of the suction cups 16 is configured for engaging a surface 18 adjacent to a sink 20 whereby the screen 12 extends over and covers the sink 20. Each suction cup 16 has a threaded connection shaft 22 extending upwardly from a bottom section 24 of the suction cup 16. The screen 12 has plurality of openings 26 extending therethrough whereby the screen 12 is configured for passing a fluid through the screen 12 permitting washing of hands and other similar uses of the sink while the assembly 10 remains in place over the sink 20. A design 28 may be imprinted onto a top surface 30 of the screen 12 to make it decorative when the screen 12 covers the sink 20.

The screen 12 may have a folded portion 64 forming a border 32 extending inwardly from the peripheral edge 14 of the screen 12. The folded portion 64 extends under the screen 12 and is coupled to a bottom surface 40 of the screen 12. A two sided tape 66 may be positioned between the folded portion 64 and the bottom surface 40 of the screen 12 to couple the folded portion 64 to the bottom surface 40 of the screen 12. The folded portion 64 may have a length between 2 centimeters and 3 centimeters.

A plurality of apertures 42 extends through the screen 12 positioned adjacent to the peripheral edge 14 of the screen 12 and extend through the border 32. Each aperture 42 may further be positioned adjacent to an associated corner 72 of the border 32. A center of each aperture 42 may be spaced from the nearest edges by a distance between 1 centimeter and 1.5 centimeters such that the aperture is centered within the border 32. An associated one of the suction cups 16 extends through each of the apertures 42. A plurality of grommets 44 is coupled to the screen 12. Each grommet 44 encircles an associated one of the apertures 42. The grommets 44 may comprise separate upper grommets 68 and bottom grommets 70, as shown in the drawing figures, each encircling an aperture 42. Upper grommets 68 may abut a top surface 30 of the sheet while the bottom grommets 70 abut a bottom surface 74 of the folded portion 64.

A plurality of caps 46 is also provided. Each cap 46 is coupled to the connection shaft 22 of an associated one of the suction cups 16. Thus, the suction cups 16 are coupled to the screen 12. Each cap 46 has an inwardly facing threaded wall 48 complimentary to the connection shaft 22 of the associated suction cup 16. An outer perimeter edge 50 of a bottom 52 of the cap 46 has a diameter greater than an inner diameter of the grommets 44 and less than an outer diameter of the grommets 44. An outer diameter of each suction cup 16 at a top edge 54 of the bottom section 24 of the suction cup 16 is greater than the inner diameter of the grommets 44 and less than the outer diameter of the grommets 44. The diameter of the outer perimeter edge 50 of each cap 46 is equal to the outer diameter of each suction cup 16 at the top edge 54 of the bottom section 24 of the suction cup 12. A plurality of spaced parallel slits 56 extends through the screen. The slits 56 are positioned in a center portion 58 of the screen 12 and extend transversely in relation to the top peripheral edge 60 of the screen 12.

In use, the screen covering assembly 10 is attached to the surfaces 18 adjacent to the sink 20 via the suction cups 16. The screen covering assembly 10 effectively conceals the contents of the sink 20. The slits 56 allow the screen to be more flexible for times when the contents of the sink extend above the surface 18 of the sink 20. When the assembly 10 is not in use, it may be easily removed from the sink 20 to allow further use of the sink 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A sink covering assembly comprising:

a screen having a peripheral edge;

a plurality of suction cups coupled to said screen, each of said suction cups being positioned adjacent to said peripheral edge of said screen, each of said suction cups being configured for engaging a surface adjacent to a sink whereby said screen extends over and covers the sink;

a plurality of apertures extending through said screen, each of said apertures being positioned adjacent to said peripheral edge of said screen;

an associated one of said suction cups extending through each of said apertures;

each suction cup having a connection shaft extending upwardly from a bottom section of said suction cup, said connection shaft of each said suction cup being threaded;

a plurality of caps, each cap being coupled to said connection shaft of an associated one of said suction cups whereby said suction cups are coupled to said screen, an outer perimeter edge of each said cap having a diameter equal to an outer diameter of each said suction cup at a top edge of said bottom section of said suction cup, said outer perimeter edge of each said cap having a diameter greater than an inner diameter of said grommets and less than an outer diameter of said grommets, an outer diameter of each said suction cup at a top edge of said bottom section of said suction cup being greater than said inner diameter of said grommets and less than said outer diameter of said grommets, each said cap having an inwardly facing threaded wall complimentary to said connection shaft;

a plurality of grommets coupled to said screen, each grommet encircling an associated one of said apertures; and a plurality of spaced parallel slits extending through said screen, said slits being positioned in a center portion of said screen.

2. The assembly of claim 1, further including a plurality of openings extending through said screen whereby said screen is configured for passing a fluid through said screen.

3. The assembly of claim 1, further including a design imprinted onto a top surface of said screen whereby said design is visible when said screen covers the sink.

4. The assembly of claim 1, further including said screen having a folded portion forming a border extending inwardly from said peripheral edge of said screen.

5. The assembly of claim 4, further including said folded portion extending under said screen and being coupled to a bottom surface of said screen.

6. The assembly of claim 4, further including a two sided tape positioned between said folded portion and said bottom surface of said screen, said tape coupling said folded portion to said bottom surface of said screen.

7. A sink covering assembly comprising:

a rectangular screen having a peripheral edge, said screen having a folded portion forming a border extending inwardly from said peripheral edge of said screen, said folded portion extending under said screen and being coupled to a bottom surface of said screen;

a two sided tape positioned between said folded portion and said bottom surface of said screen, said tape coupling said folded portion to said bottom surface of said screen;

a plurality of suction cups coupled to said screen, each of said suction cups being positioned adjacent to said peripheral edge of said screen, each of said suction cups being configured for engaging a surface adjacent to a sink whereby said screen extends over and covers the sink, each suction cup having a connection shaft extending upwardly from a bottom section of said suction cup, said connection shaft of each said suction cup being threaded;

a plurality of openings extending through said screen whereby said screen is configured for passing a fluid through said screen;

a design imprinted onto a top surface of said screen whereby said design is visible when said screen covers the sink;

a plurality of apertures extending through said screen, each of said apertures being positioned adjacent to said peripheral edge of said screen and extending through said border, each said aperture being positioned at an associated corner of said border, an associated one of said suction cups extending through each of said apertures;

a plurality of grommets coupled to said screen, each grommet encircling an associated one of said apertures;

a plurality of caps, each cap being coupled to said connection shaft of an associated one of said suction cups whereby said suction cups are coupled to said screen, each said cap having an inwardly facing threaded wall complimentary to said connection shaft of said associated suction cup;

an outer perimeter edge of a bottom of each said cap having a diameter greater than an inner diameter of said grommets and less than an outer diameter of said grommets;

an outer diameter of each said suction cup at a top edge of said bottom section of said suction cup being greater than said inner diameter of said grommets and less than said outer diameter of said grommets, said diameter of said outer perimeter edge of each said cap being equal to said outer diameter of each said suction cup at said top edge of said bottom section of said suction cup; and a plurality of spaced parallel slits extending through said screen, said slits being positioned in a center portion of said screen.

* * * * *